US006719180B2

(12) United States Patent
Shah

(10) Patent No.: US 6,719,180 B2
(45) Date of Patent: Apr. 13, 2004

(54) HAND HELD TAPE DISPENSER

(75) Inventor: Kumud Shah, Nairobi (KE)

(73) Assignee: Conros Corporation, North York ( * ) Notice: Subject to any disclaimer, the term of this patent is extended or adjusted under 35 U.S.C. 154(b) by 169 days.

(21) Appl. No.: 09/985,327

(22) Filed: Nov. 2, 2001

(65) Prior Publication Data

US 2003/0085250 A1 May 8, 2003

(51) Int. Cl.[7] ..... B26F 3/02

(52) U.S. Cl. ..... 225/56; 225/57; 225/65; 225/66; 225/77

(58) Field of Search ..... 225/41, 61, 62, 225/65, 66, 56, 57

(56) References Cited

U.S. PATENT DOCUMENTS 2,677,425 A * 5/1954 Broyles ..... 225/56
2,750,029 A * 6/1956 Morgan ..... 225/7
4,961,525 A 10/1990 Corbo et al.
5,468,332 A 11/1995 Dretzka et al.
5,820,005 A * 10/1998 Perkitny et al. ..... 225/65
5,851,347 A * 12/1998 Rodriguez ..... 156/576

* cited by examiner

*Primary Examiner*—Allan N. Shoap
*Assistant Examiner*—John Windmuller
(74) *Attorney, Agent, or Firm*—Marks & Clerk

(57) ABSTRACT

A tape dispenser for mailing tape has planar side walls, a front portion having a cover and a cutter member, and a rear portion including hub portions with at least an arcuate portion in the top region so that a roll of mailing tape may be rotatably mounted in the tape dispenser. Cover wing portions extend inwardly from each of the side walls in the upper regions so as to cover the edges of a roll of tape when it is installed in the tape dispenser. Comfort to the hand of the user is assured because the sharp edges of the roll of tape are shielded from the hand. The sidewalls are sufficiently flexible to permit removal and insertion of an empty core or a new roll of tape, and have elastic memory so as to assume their unflexed and planar condition after a new roll of tape has been installed. Typically, the transition between the cover wing portions and the planar side walls is curved. The tape dispenser is injection moulded from a polymeric plastics material.

8 Claims, 4 Drawing Sheets

HAND HELD TAPE DISPENSER

FIELD OF THE INVENTION

This invention relates to tape dispensers, and particularly this invention relates to tape dispensers of the sort utilized to dispense tape which is typically employed for purposes of the sealing boxes and packages. Such tape typically has a width of two inches up to 3.5 inches; and typically such tape is wound on a core which has an inner diameter in the range of 1.5 to 3 inches. The present invention provides a tape dispenser from which a length of tape may be dispensed and cut from the roll of tape, where the hand of the person operating the tape dispenser is protected from contacting the edges of the roll of tape mounted in the dispenser.

BACKGROUND OF THE INVENTION

The type of tape for which dispensers in keeping with present invention are provided is typically referred to as "mailing tape". As noted, mailing tape typically has a width of from two inches up to about 3.5 inches, and the tape is wound on cylindrical cores which have the same width as the tape and which have an inner diameter in the range of 1.5 to 3 inches. The tape is intended to be unwound or unreeled from the core when the core is mounted in a dispenser. Quite often, in mailing rooms which have large volumes, and packing rooms where cardboard boxes may be erected and taped using wide tape, the dispenser for the tape is large and/or automated. On the other hand, it may very often occur, especially in small mailing rooms or offices, and very often in household purposes, that a smaller roll of mailing tape is required to be used in such a manner that essentially the mailing tape is to be held in the hand.

However, it is inconvenient to dispense or unreel tape directly from a roll without the use of the dispenser of some sort into which the roll of tape has been rotatably mounted. Moreover, such dispenser must be small enough to be held in the hand, and to be manipulated so as to permit a length of tape to be dispensed from the roll of tape, and then to be cut therefrom using a cutter member which is an integral part of the dispenser.

On the other hand, such dispensers as are presently known for hand held dispensing of mailing tape, as discussed hereafter, are both awkward to use and are uncomfortable to use, especially by female persons who typically have smaller hands, the skin of which may be less callused than those of a male co-worker.

The inventor herein has unexpectedly discovered that the provision of a pair of cover wing portions which extend over the edges of the roll of tape mounted in the tape dispenser not only provides structural rigidity when the dispenser is in use, but greater comfort to the hand of the user is afforded. On the other hand, the provision of the pair of cover wing portions does not significantly affect the flexibility of the side walls of the dispenser, so that a used core may be removed from the dispenser and a new roll of tape may be installed in the dispenser.

DESCRIPTION OF THE PRIOR ART

U.S. Pat. No. 5,468,332 issued Nov. 21, 1995 to Dretzka et al, teaches a tape dispenser having a polymeric frame with a cutter mounted on one end and an arched portion in the upper region of the dispenser. The arched portion is resiliently flexible, having a generally cylindrically concave surface adjacent the periphery of the roll of tape, and is adapted to be received in the palm of the hand of a user to space the user's hand away from the rotating roll of tape as it is being dispensed. However, as it happens, the edges of a roll of tape mounted in commercial embodiments of the tape dispenser remain exposed, and they are typically in contact with the hand of the user.

The patent also teaches a pair of inwardly directed tab portions which are defined at their edges by cam surfaces, and which have arcuate retaining surfaces in the upper region of each tab portion. The purpose of the cam surfaces is to urge the tape into the region adjacent the cutter member, so that the tape may be cut upon appropriate manipulation of the dispenser.

Another U.S. Pat. No. is 4,961,525 issued Oct. 9, 1990 to Corbo et al. That patent teaches a reusable tape dispenser where the edges of the roll of tape mounted in the dispenser are fully exposed. The dispenser has a pair of flexible side walls which are secured using releasable locking means. Also, a pair of opposed tabs are located beneath a base wall portion to provide guides for the tape as it is being dispensed, and to assure its proximity to the cutter member.

SUMMARY OF THE INVENTION

The present invention provides a tape dispenser for dispensing a length of tape from a roll of tape which is rotatably mounted thereon, and for cutting the dispensed length of tape away from the roll of tape. The tape dispenser comprises a body which has a rear portion and a front portion, and a cutter member which is disposed at the front edge of the front portion.

The body has a pair of substantially planar side walls, and a pair of inwardly directed hub portions which are located in the rear portion of the body. Each of the hub portions has at least an arcuate portion in the top region thereof, and the arcuate portion is adapted so as to rotatably support the core of a roll of tape when placed thereon.

A cover portion extends between the side walls in the front portion of the body, behind the cutter member.

A cover wing portion extends inwardly from each side wall in the upper region of the rear portion of the body, so as to cover the edges of a roll of tape in that upper region when the roll of tape is placed in the tape dispenser.

The pair of side walls is sufficiently flexible so as to permit them to be spread apart in the rear portion thereof in order to remove or install a roll of tape over the hub portion. The pair of side walls have elastic memory so as to restore themselves to a normal unflexed condition whereby each of the side walls is substantially planar.

Typically, the transition between each of the planar side walls and each of the cover wing portions is curved.

The cover wing portions may typically extend inwardly from each of the side walls also in the rear region of the rear portion of the body.

A pair of tabs may be provided, which extend inwardly from the pair of side walls in the front region of the rear portion of the body, below the cover portion. Each of the tabs includes an arcuate retaining surface which extends forwardly therefrom.

Typically, there is at least one opening that is formed through the transition area between each of the cover wing portions and the respective one of the pair of side walls.

There may be a pair of ribbed finger rests that are formed on the pair of side walls in the region between the front portion and the rear portion thereof.

The arcuate hub portion of each of the side walls defines a horizontally disposed centre axis of rotation which extends sideways through the rear portion of the body, so as to rotatably mount a roll of tape in the tape dispenser.

Typically, the body of the tape dispenser of the present invention is injection molded from a polymeric plastics material chosen from the group consisting of ABS, polystyrene, and combinations thereof.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
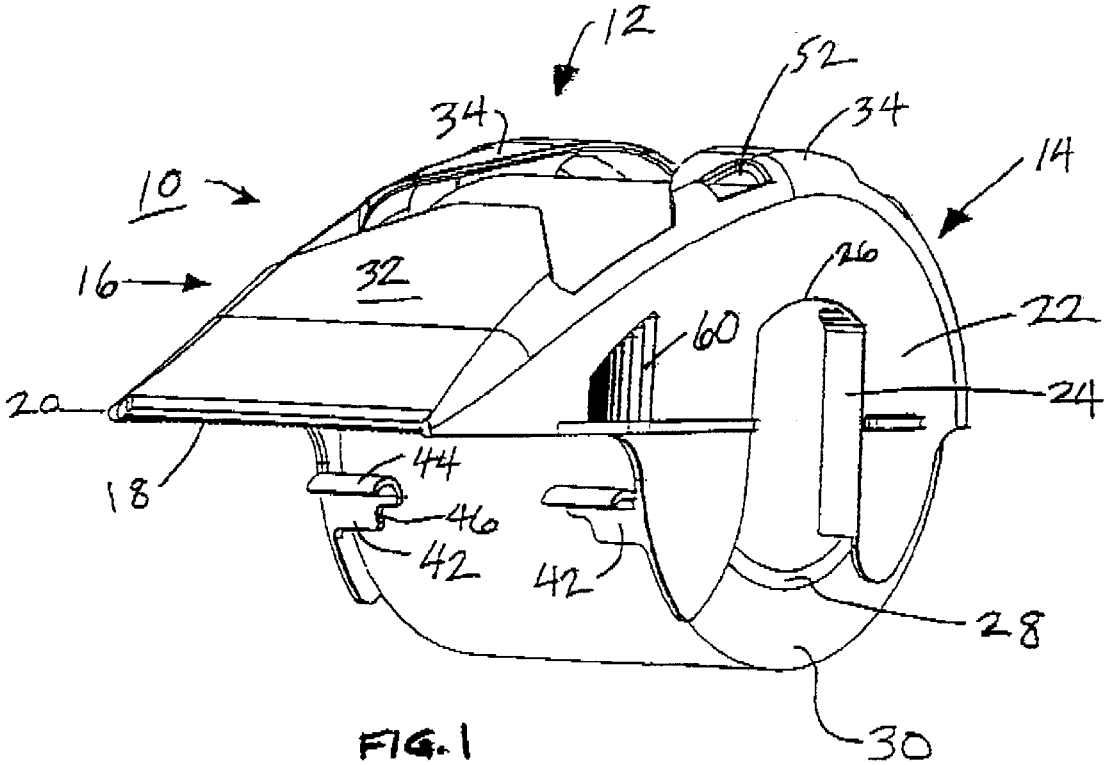
FIG. 1 is a perspective view of the tape dispenser of the present invention, as seen from the front.
Figure 2:
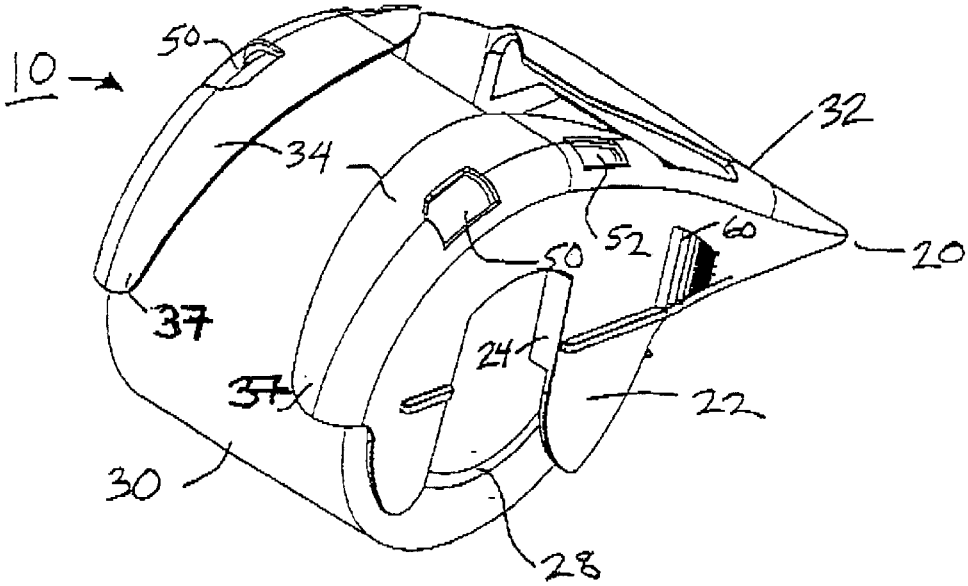
FIG. 2 is a perspective view of the tape dispenser of the present invention, as seen from the rear.

The novel features which are believed to be characteristic of the present invention, as to its structure, organization, use and method of operation, together with further objectives and advantages thereof, will be better understood from the following discussion.

The tape dispenser of present invention is shown at 10 through the Figures now being discussed. It will be understood from even a cursory review of the drawings that it is clearly intended that the tape dispenser is one which is to be held in the hand; and it will be seen that the tape dispenser has a generally squat configuration—meaning that the tape dispenser is just somewhat longer than it is wide, and with a roll of tape rotatably mounted therein it is just slightly higher than it is wide.

Thus, the tape dispenser is one which is particularly intended for use with mailing tape and the like. However, the configuration of the tape dispenser is such that, when it is in use, there is no discomfort to the hand of the user due to contact of the hand with the sharp edges of the roll of tape, particularly as the roll of tape is rotating. Accordingly, it will be easily understood that the purpose of the tape dispenser of the present invention is to dispense a length of tape from a roll of tape which is rotatably mounted therein; and because the tape dispenser includes a cutter member, as will be discussed hereafter, it is clear that by appropriate manipulation of the tape dispenser the length of tape may be cut away from the roll after it has been dispensed.

The tape dispenser 10 comprises a body portion which is shown generally at 12, and which has a rear portion 14 and a front portion 16. A cutter member 18 is disposed at the front edge 20 of the front portion 16. Typically, the cutter member 18 has a serrated leading edge so as to assist in and assure a cutting action upon appropriate manipulation of the tape dispenser against a dispensed length of tape, in the well known manner.

The body 12 has a pair of substantially planar side walls 22. There is also a pair of inwardly directed hub portions 24 which are formed in the substantially planar side walls; and it will be seen that there is an arcuate portion 26 which is formed in the top region of each hub portion. Thus, it will be understood that the hub portions 24 are adapted to rotatably support a core 28 of a roll of tape 30.

There is a cover portion 32 which is formed in the front portion 16 between the planar side walls 22. The cover portion 32 is positioned behind the cutter member 18.

There is also a pair of cover wing portions 34, each of which extends inwardly from the respective substantially planar side wall 22, in the rear portion 14 of the body 12. It will be easily appreciated, particularly from a review of FIGS. 1 to 6, and FIG. 8, that the cover wing portions 34 cover the sharp edges 36 (see FIG. 6, in particular) in the upper region of the roll of tape 30 when the roll of tape is installed in the tape dispenser 10.

Of course, it will be understood that when the tape on a roll of tape 30 has been depleted, it will be necessary to remove the empty core 28 away from the tape dispenser 10 so as to install a new roll of tape 30. For that purpose, the side walls 22 must be sufficiently flexible that they may be spread apart in a manner so as to spread their tail portions 37 away from each other. The flexibility of the substantially planar side walls 22 is such that a core 28 may be removed from or placed over the hub portions 24. Moreover, the material of the pair of side walls 22 possesses elastic memory, so that after the pair of side walls 22 have been flexed outwardly they will restore themselves to their normal unflexed condition so as to once again assume their normal substantially planar condition.

Figure 3:
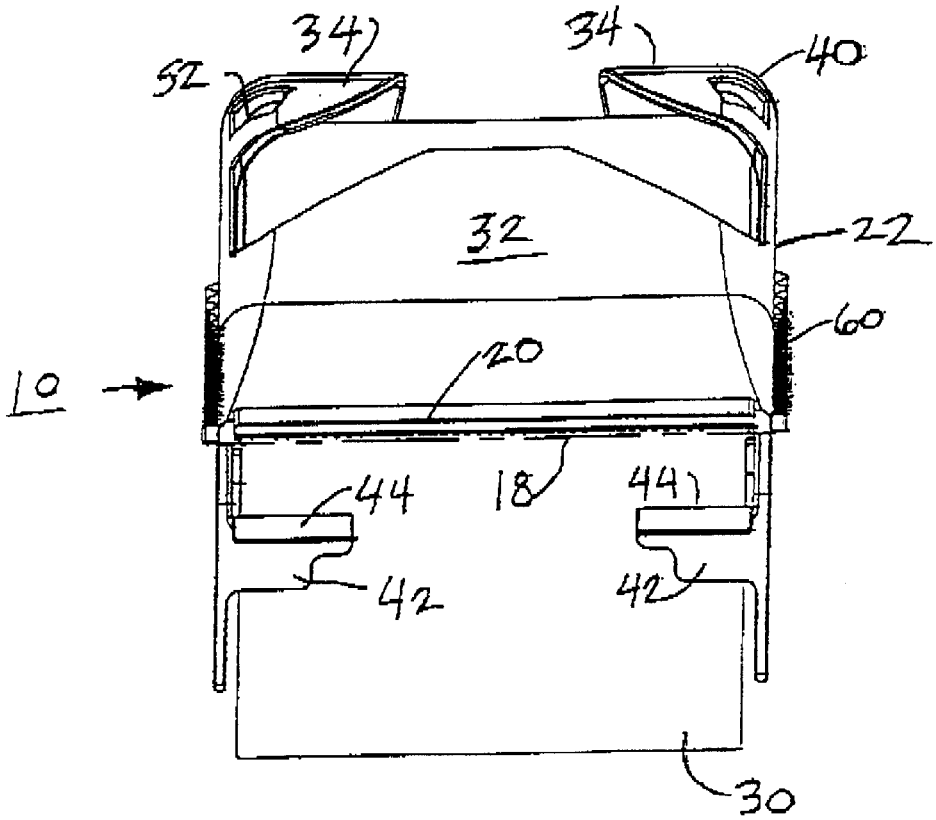
FIG. 3 is a front view of the tape dispenser.
Figure 4:
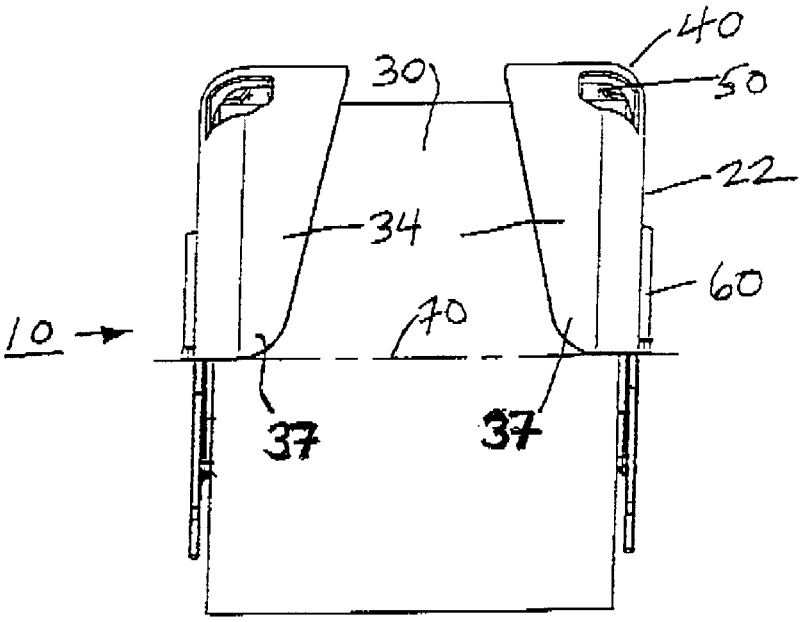
FIG. 4 is a rear view of the tape dispenser.
Figure 6:
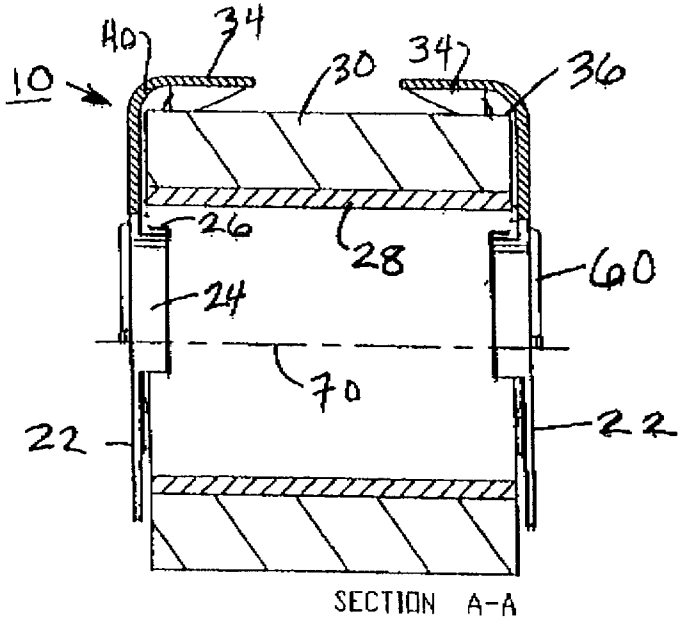
FIG. 6 is a sectional view of the tape dispenser along the line A—A in FIG. 5.
Figure 5:
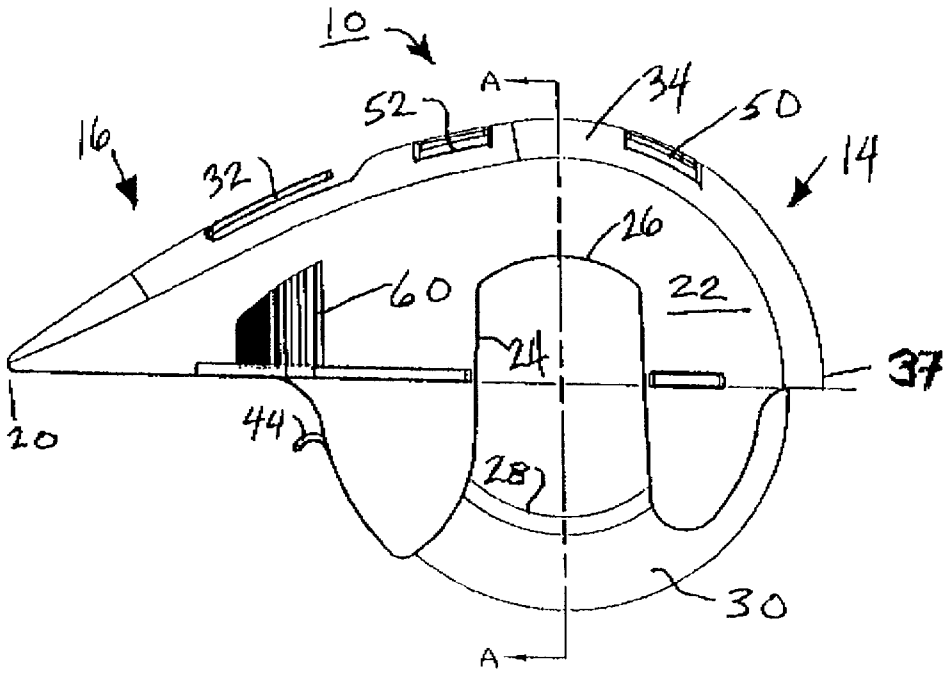
FIG. 5 is a side view of the tape dispenser.
Figure 7:
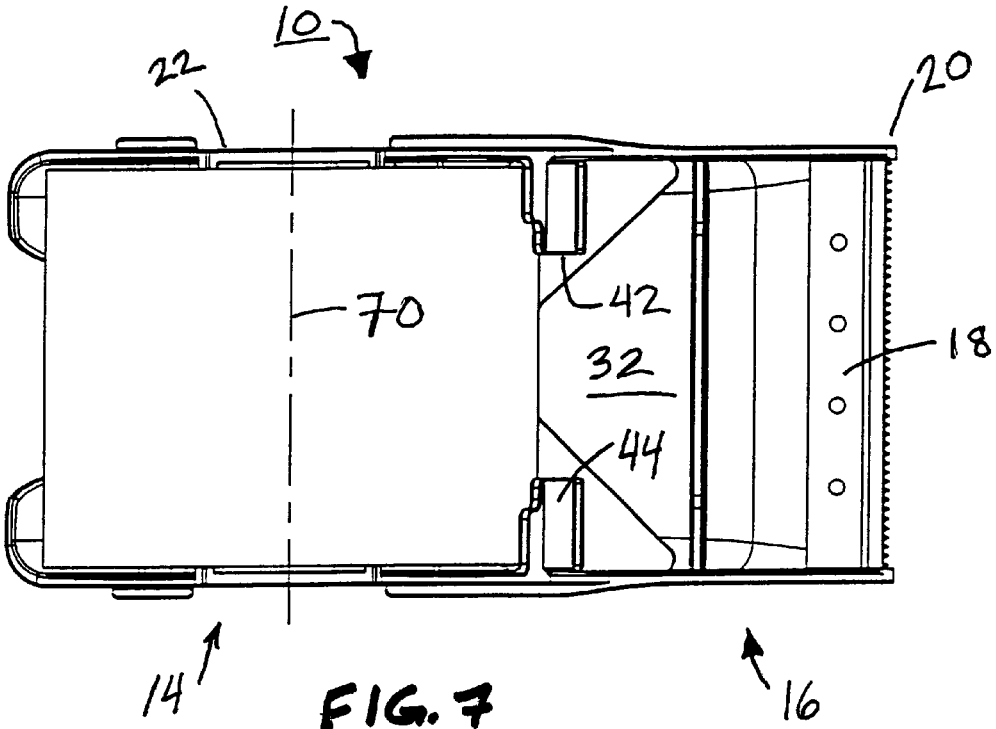
FIG. 7 is a bottom view of the tape dispenser.
Figure 8:
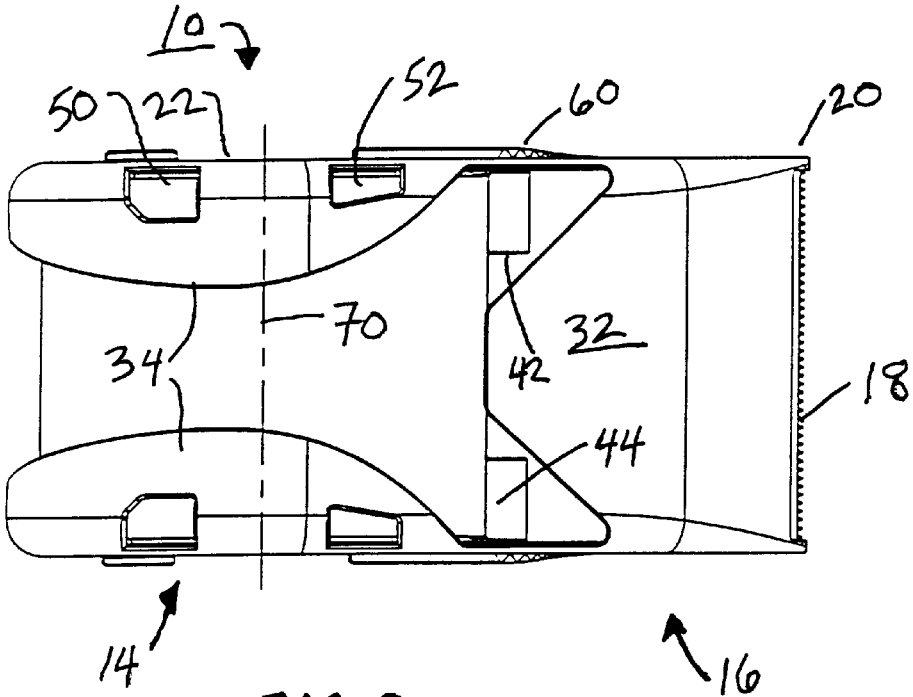
FIG. 8 is a top view of the tape dispenser.

Typically, the transition region between each of the substantially planar side walls 22 and the cover wing portions 34 is curved, as seen particularly at 40 in FIGS. 3, 4 and 6. Thus, when the tape dispenser 10 is in use, the hand of the user does not contact or encounter any sharp edges. It will also be seen, particularly in FIGS. 2, 4, and 5, that the cover wing portions 34 also extend inwardly from each side wall 22 in the rear region of the rear portion 14 of the body 12, particularly so that the tail portions 37 lie substantially in the same horizontal plane as the front edge 20, as seen in FIG. 5.

It will be seen particularly in FIGS. 1, 3, 5, 7, and 8, that there is a pair of tabs 42 which extend inwardly from the respective substantially planar side walls 22, in the front region of the rear portion 14, in a position below the cover portion 32. Typically, the tabs 42 have a stepped configuration as shown particularly at 46. The purpose for the stepped configuration 46 is to guide a length of tape upwardly towards the cutter member 18 in the event that the tape may be being dispensed from the roll of tape 30 in a locus which leads it below the tabs 42. It will be understood, of course, that the upper side of the length of tape being dispensed from the roll of tape 30 has no adhesive on it, so that it will not bind.

It will also be seen that each of the tabs 42 includes an arcuate retaining surface 44 which extends forwardly from the respective tab 42 in the upper region thereof.

The purpose of the retaining surfaces 44 is to permit the end of the remaining tape on the roll of tape 30, after a previous length of tape has been cut away from the roll of tape, to be retained in place by placement of the adhesive on the underside of the mailing tape in the region of the end thereof against the retaining surfaces 44. Accordingly, the remainder of the tape on the roll of tape 30 will be available for dispensing simply by placing the adhesive underside of the end of the tape against the next surface to which the mailing tape will be adhered.

In general, there is at least one opening 50 or 52 which is formed through the transition area between the substantially planar side walls 22 and the respective cover wing portions 34. The openings 50 and/or 52 provide visual assurance that the edges of the roll of tape 30 are properly aligned, and thus there is assurance that the roll of tape 30 is properly mounted on the hub portions 24.

In order to assist in the dispensing of a length of tape from the roll of tape 30, and also to assist in the manipulation of the tape dispenser so as to cut a length of tape when desired, a pair of ribbed finger rests 60 may be formed so as to stand out from the substantially planar side walls 22. The ribbed finger rests 60 are formed on the respective planar side walls in the region thereof between the front portion 16 and the rear portion 14.

As seen particularly in FIGS. 4, 6, 7, and 8, the arcuate hub portion 26 of each one of the hubs 24 defines a horizontally disposed centre axis of rotation 70 which extends sideways through the rear portion 14 of the body 12, so as to thereby rotatably mount a roll of tape 30 in the tape dispenser 10.

Typically, the body of the tape dispenser 10 in keeping with the present invention is injection moulded from a polymeric plastics material which may be chosen from the group consisting of ABS, polystyrene, and combinations thereof. Also, typically the cutter member 18 is formed of stamped metal, which may be present in the mould cavity when the body of the tape dispenser is injection moulded; or the cutter member may be added to the body of the tape dispenser after it has been moulded, in another operation.

It will now be quite clear that a number of the shortcomings of prior art hand held tape dispensers, particularly as they relate to the comfort of the hand of the user, as well as the ease with which an empty core 28 may be removed and a new roll of tape 30 installed, have been overcome by the tape dispenser 10 of the present invention.

However, it will also be understood that other modifications and alterations may be used in the design and manufacture of the apparatus of the present invention, without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A tape dispenser for dispensing a length of tape from a roll of tape rotatably mounted thereon, and for cutting the dispensed length of tape away from the roll of tape, said tape dispenser comprising:

a body having a rear portion and a front portion; and a cutter member disposed at a front edge of said front portion;

said body having a pair of substantially planar side walls, and a pair of inwardly directed hub portions located in the rear portion thereof, said hub portions each having at least an arcuate portion in the top region thereof so as to be adapted to rotatably support a core of a roll of tape when placed thereon;

a cover portion extending between the side walls in the front portion of said body, behind said cutter member, and a cover wing portion extending inwardly from each side wall in the upper region of said rear portion of said body, so as to cover the edges of a roll of tape in that upper region when placed in said tape dispenser;

said pair of side-walls being sufficiently flexible so as to permit them to be spread apart in the rear portion thereof in order to remove or install a roll of tape over said hub portions, and said pair of side walls having elastic memory so as to restore themselves to a normal unflexed condition whereby each of said side walls is substantially planar.

2. The tape dispenser of claim 1, wherein the transition between each of said planar side walls and each of said cover wing portions is curved.

3. The tape dispenser of claim 2, wherein said cover wing portions further extend inwardly from each side wall in the roar region of said rear portion of said body.

4. The tape dispenser of claim 1, further including a pair of tabs extending inwardly from said pair of side walls in the front region of said rear portion thereof, below said cover portion;

wherein each of said tabs includes an arcuate retaining surface extending forwardly therefrom.

5. The tape dispenser of claim 2, wherein at least one opening is formed through the transition area between each of said cover wing portion and the respective one of said pair of side walls.

6. The tape dispenser of claim 1, wherein a pair of ribbed finger rests are formed on said pair of side walls in the region between said front portion and said rear portion thereof.

7. The tape dispenser of claim 1, wherein said arcuate hub portion defines a horizontally disposed centre axis of rotation extending sideways through said rear portion of said body, so as to rotatably mount a roll of tape in said tape dispenser.

8. The tape dispenser of claim 1, wherein said body is injection molded from a polymeric plastics material chosen from the group consisting of ABS, polystyrene, and combinations thereof.

* * * * *